US006283573B1

(12) United States Patent
Nakamura

(10) Patent No.: US 6,283,573 B1
(45) Date of Patent: Sep. 4, 2001

(54) INK JET-TYPE PRINTER CONTROL WITH INK PURGING FUNCTION

(75) Inventor: Hirotake Nakamura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/024,580

(22) Filed: Feb. 18, 1998

(30) Foreign Application Priority Data

Mar. 28, 1997 (JP) ..... 9-095163

(51) Int. Cl.[7] ..... B41J 2/165; B41J 2/175

(52) U.S. Cl. ..... 347/23; 347/35; 347/30; 347/86; 347/87

(58) Field of Search ..... 347/23, 35, 30, 347/36, 29, 31, 32, 87, 86, 33

(56) References Cited

U.S. PATENT DOCUMENTS 5,140,429 * 8/1992 Ebinuma et al. ..... 347/23
5,170,186 * 12/1992 Shimamura et al. ..... 347/23
5,475,404 * 12/1995 Takahashi et al. ..... 347/23
5,572,242 * 11/1996 Fujii et al. ..... 347/23
5,596,354 * 1/1997 Murphy ..... 347/30
5,625,384 * 4/1997 Numata et al. ..... 347/23
6,042,214 * 3/2000 Minowa et al. ..... 347/23

* cited by examiner

*Primary Examiner*—John Barlow
*Assistant Examiner*—Charles W. Stewart, Jr.
(74) *Attorney, Agent, or Firm*—Oliff & Berridge, PLC

(57) ABSTRACT

An ink jet-type printer apparatus has a purging device which purges ink in an ink cartridge through ink jet nozzles by applying vacuum to the ink jet nozzles at the time of exchange of the ink cartridge and before normal printing operation. It is first determined whether a previous purging operation is an initial one which is performed at the time of the exchange of the ink cartridge. The next purging operation is performed at an earlier timing if the determination is Yes, while it is performed at a later timing if the determination is No. In each instance, the amount of ink to be purged is increased as the time period elapsed from the previous purging operation is longer. The amount of ink to be purged is varied by the number of times of purging in each purging operation.

30 Claims, 4 Drawing Sheets

FIG. 3A

PREVIOUS PURGING BEING INITIAL PURGING (P=1)

90

| NUMBER OF DAYS FROM PREVIOUS PURGING | NUMBER OF PURGINGS |
|---|---|
| $3 < T \leqq 6$ | 1 |
| $6 < T \leqq 9$ | 2 |
| $9 < T$ | 3 |
| INITIAL PURGING | 6 |

FIG. 3B

PREVIOUS PURGING BEING NOT INITIAL PURGING (P=0)

91

| NUMBER OF DAYS FROM PREVIOUS PURGING | NUMBER OF PURGINGS |
|---|---|
| $5 < T \leqq 10$ | 1 |
| $10 < T \leqq 15$ | 2 |
| $15 < T$ | 3 |
| NORMAL PURGING | 1 |

INK JET-TYPE PRINTER CONTROL WITH INK PURGING FUNCTION

CROSS REFERENCE TO RELATED APPLICATION

The present application relates to and incorporates herein by reference Japanese Patent Application No. 9-95163 filed on Mar. 28, 1997.

BACKGROUND OF THE INVENTION

1. Field of the Invention

The present invention relates to an ink jet-type printer apparatus which jets ink droplet onto a print medium and, more particularly, to an ink jet-type printer control having an ink purging function for evacuating vaporized ink and dried ink from nozzles of a printer head to restore desired ink jetting operation of the nozzles.

2. Description of Related Art

It is known in a conventional ink jet-type printer apparatus to use an ink purging device which covers the nozzle forming surface of a printer head by an evacuation cap and evacuates the undesired or degraded ink from nozzles by vacuuming the inside space of the evacuation cap by a pump.

When a used ink cartridge coupled with the printer head are exchanged for a new one, it occurs that air enters into an ink supply passage connecting the ink cartridge and the printer head. This air is likely to admix with the ink in the ink supply passage and become bubbles. Further, gas produced in the ink through adhesives between manifold members providing the ink supply passage becomes bubbles in the ink. The bubbles in the ink grow bigger as time passes. As the bubbles are bigger and the number increases more, more ink must be evacuated to eliminate such bubbles.

The printer head may be covered by a capping device to restrict drying of the ink when the printer apparatus is not in use. Even in this instance, the ink will become dried gradually as time passes resulting in degradation of ink.

The conventional ink purging device is designed to perform the evacuation operation a fixed number of times irrespective of the time period for which the printer apparatus is not used. Therefore, the bubbles in the ink and the dried ink may not be evacuated unless the evacuation is performed timely. As a result, there will occur that the required ink jetting operation cannot be restored by the fixed number of evacuation operations or that the ink may be wastefully evacuated if the purging is performed too frequently.

SUMMARY OF THE INVENTION

It is therefore an object of the present invention to provide an ink jet-type printer control which obviates the conventional drawbacks.

It is another object of the present invention to provide an ink jet-type printer control which varies an ink purging operation in accordance with a time period elapsed from the previous ink purging for assuring a quality printing without wasting ink.

It is a further object of the present invention to provide an ink jet-type printer control which varies an ink purging operation in accordance with whether the previous purging is the initial one after an exchange of cartridges for assuring a quality printing without wasting ink.

According to the present invention, an improved ink purging control is provided for an ink jet-type printer apparatus having a printer head including an ink cartridge for storing ink therein and nozzles for jetting the ink stored in the ink cartridge. In the purging control, a purging operation is variably controlled in response to the relation of the purging relative to the previous purging. The relation is defined by a time period of non-use of the nozzles to a present use of the nozzles, i.e., the time period between the previous ink purging operation of the ink jet nozzles and the present ink jetting operation of the ink jet nozzles. Alternatively, the relation is defined as whether the previous ink purging operation is the initial one after an exchange of the ink cartridge.

The amount of ink to be purged before the printing operation is increased in response to an increase in the measured time period and/or the amount of ink to be purged in response to the determination of the previous purging operation being the initial one is set to more than that to be purged in response the determination of the previous purging operation being a noninitial one even if the measured time period is the same. Alternatively, the ink purging operation is enabled to occur in a shorter period from the previous purging in response to the determination of the previous purging being the initial one than in response to the determination of the previous purging being the non-initial one.

Preferably, the amount of the ink to be purged in the initial purging operation is set to the largest amount of any other amounts of the ink to be purged.

Preferably, the ink purging operation is performed by a purging device which vacuums the nozzles. The amount of ink to be purged is determined by a number of times of vacuuming the nozzles.

BRIEF DESCRIPTION OF THE DRAWINGS

Other objects, features and advantages of the present invention will become more apparent from the following detailed description when read with reference to the accompanying drawings. In the accompanying drawings:

FIGS. 3A and 3B are tables showing purging data used in the control system shown in FIG. 2 and corresponding respectively to the cases of previous purging operation being initial and noninitial after an exchange of an ink cartridge.

DETAILED DESCRIPTION OF THE PREFERRED EMBODIMENT

The present invention will be described in more detail with reference to a presently preferred embodiment in which a piezoelectric device is used to jet ink droplets.

Figure 1:
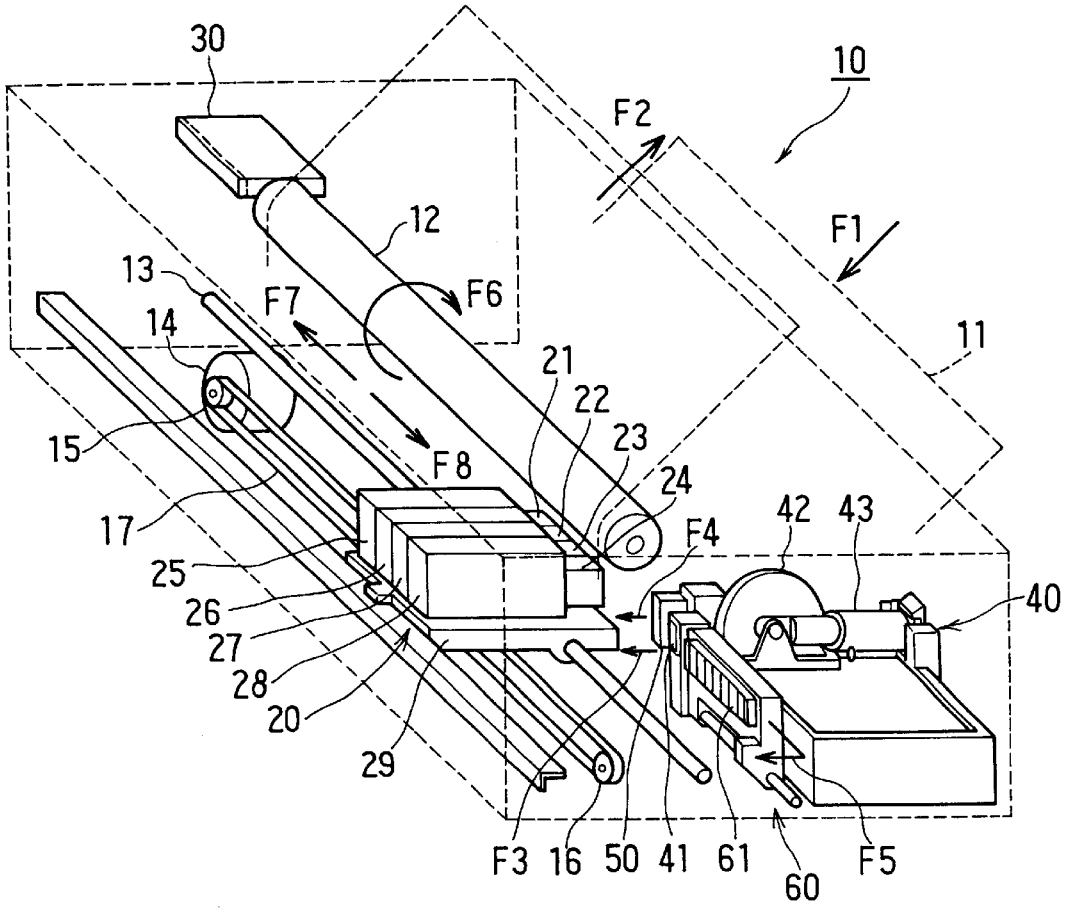
FIG. 1 is a schematic perspective view showing the internal construction of an ink jet-type printer apparatus according to an embodiment of the present invention.

An ink jet-type printer device 10 shown in FIG. 1 has a platen roller 12 which feeds in an arrow direction F2 a paper 11 supplied in an arrow direction F1. A carriage shaft 13 is mounted below the platen roller 12 in parallel with the longitudinal axis of the platen roller 12. Thee carriage shaft 13 supports movably a carriage 29 having a printer head 20 thereon. A carriage motor 14 and a pulley 16 are mounted below the left and the right axial ends of the carriage shaft 13, respectively. A pulley 15 is attached to the rotary shaft of the carriage motor 14. The pulleys 15 and 16 are connected by an endless belt 17 to which the carriage 29 is fixed, so that the carriage 29 slidingly reciprocates on the carriage shaft 13 in arrow directions F7 and F8 when the carriage motor 14 rotates.

The printer head 20 has four ink jet heads 21 through 24 which jet black ink, yellow ink, cyan ink and magenta ink respectively toward the paper 11. The ink jet heads 21 through 24 are coupled with ink cartridges 25 through 28 which supplies respective ink to corresponding heads.

As known well in the art, the ink jet heads 21 through 24 has respective ink chambers (not shown) for storing the ink supplied from the corresponding ink cartridge 25 through 28. Ink jet nozzles (not shown) are formed on each surface of the ink chamber facing the platen roller 12 so that the ink is jetted onto the paper. A part of the walls defining the ink jet chamber is made of a piezoelectric element which deforms in response to a driving voltage applied thereto and changes the volume of the ink chamber. The reduction in volume of the ink chamber causes the ink in the ink chamber to be jetted as ink droplets through the nozzles, thereby attaining printing on the paper 11.

Adjacent to the leftmost axial end of the platen roller 12 which is outside the printing area, a wasted-ink absorbing pad 30 made of a porous material is provided for absorbing the ink wastedly jetted from the ink jet heads 21 through 24 at the time of flushing, i.e., preparatory ink jetting from the ink jet heads 21 through 24. The flushing may be performed before the printing operation of the printer head 20 and periodically in the course of the printing operation of the printer head 20. This flushing protects the nozzles of the ink jet heads 21 through 24 from being dried, thereby preventing insufficient ink jetting which would otherwise be caused by the dry nozzles.

Adjacent to the rightmost axial end of the platen roller 12 which is outside the printing area, a purging device 40 is provided to restore normal ink jetting operation of the ink jet heads 21 through 24 from non-jetting or insufficient jetting. The purging device 40 has an evacuation cap 41 which is selectively attachable to the nozzle-forming surface of the ink jet heads 21 through 24. The evacuation cap 41 is advanced in an arrow direction F3 by a cam 42 to cover the nozzle-forming surface of one ink jet head which is in the purging position, when the ink jet head which is to be subjected to purging arrives at the purging position where the evacuation cap 41 is located. With one nozzle-forming surface of the ink jet heads 21 through 24 being covered tightly by the evacuation cap 41, a pump 43 is driven to vacuum the space formed by the nozzle-forming surface and the evacuation cap 41. Thus, the ink admixed with bubbles is evacuated from the nozzles of the cap-covered ink jet head, thereby restoring a desirable ink jetting condition from the degraded jetting operation.

The purging device 40 also has at the leftmost part thereof a wiper member 50 which wipes out ink and foreign matters remaining on the nozzle-forming surface of the evacuated head. The wiper member 50 may be advanced in an arrow direction F4 after the completion of purging to wipe out the nozzle-forming surfaces of the ink jet heads 21 through 24 when the ink jet heads moves from the purging area to the printing area. Thus, the paper 11 may be maintained clean without being stained by the ink and the like remaining on the ink jet heads after purging.

A capping device 60 is provided at the right side of the purging device 40 to cover the nozzle-forming surfaces of the ink jet heads 21 through 24 by its cap 61 when the printer head 20 is at its home position. More specifically, the cap 61 is advanced in an arrow direction F5 to cover the ink jet heads 21 through 24 when the printer head 20 returns to the home position after the printing operation. Thus, the ink in the ink jet heads 21 through 24 can be restricted from drying while being held not in operation.

Figure 2:
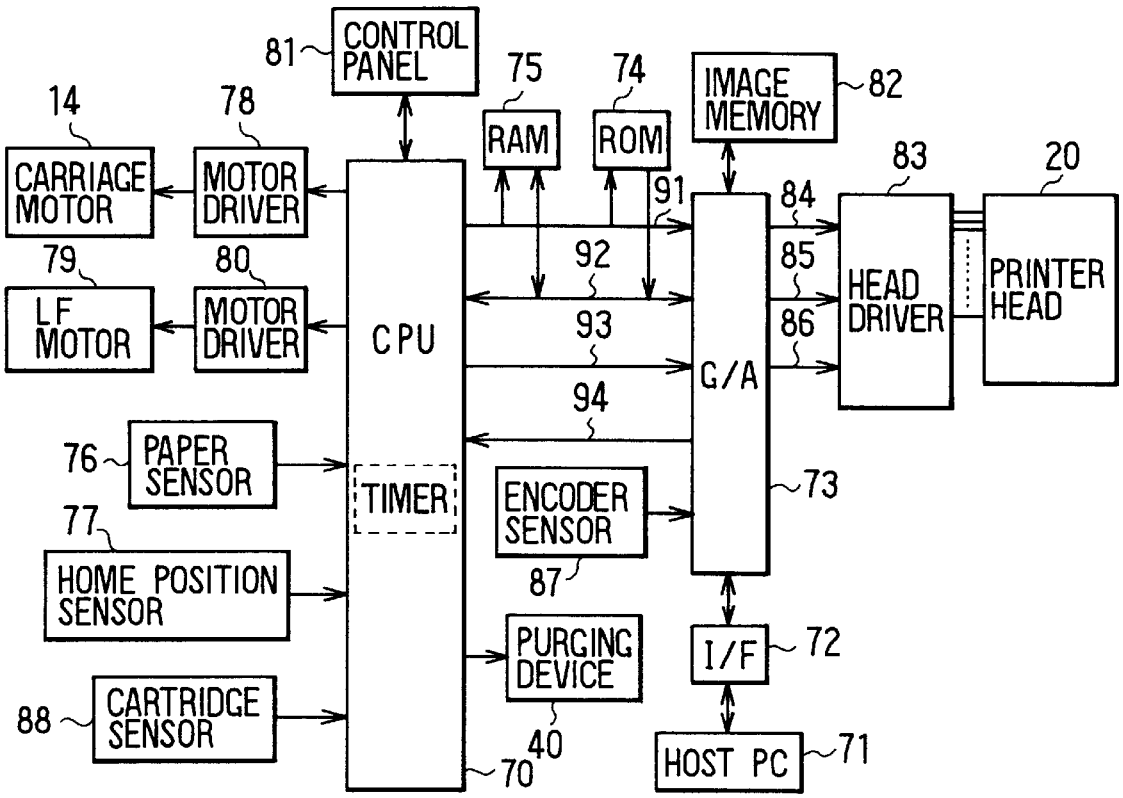
FIG. 2 is an electronic wiring diagram showing an electronic control system in the embodiment shown in FIG. 1.

The ink jet-type printer apparatus 10 has an electronic control system shown in FIG. 2. The control system includes a CPU 70 for producing a print operation command to the printer head 20 and controlling the flushing operation, the purging operation of the purging device 40 and the like of the above devices, and a gate array circuit (G/A) 73 for receiving print data sent from a host computer (PC) 71 through an interface circuit (I/F) 72. A ROM 74 storing therein various programs for the printing control, flushing control, purging control and the like and a RAM 75 for temporarily storing the print data received by the gate array circuit 73 from the host computer 71 are provided between the CPU 70 and the gate array circuit 73 and connected to an address bus 91 and a data bus 92. The CPU 70 and the gate array circuit 73 are connected to each other through print timing signal line 93 an interrupt signal line 94 as well as through the buses 91 and 92.

The CPU 70 includes a timer which is used for controlling the purging device 40. The CPU 70 is connected to a paper sensor 76 for detecting the presence/absence of the paper 11, a home position sensor 77 for detecting the home position of the printer head 20 and an ink cartridge sensor 88 for detecting exchange of the ink cartridges 25 through 28. It is also connected to a first motor driver 78 for driving the carriage motor 14, a second motor driver 80 for driving a line feed motor 79 for rotating the platen roller 12, and a control panel 81 for supplying various signals, etc.

An image memory 82 for temporarily storing the print data received from the host computer 71 as image data is connected to the gate array circuit 73. An ink jet head driver 83 operates based on signals on print data line 84, a transfer clock line 85 and a print clock line 86 outputted from the gate array circuit 73 so as to drive the printer head 20. An encoder sensor 87 for measuring a travelling speed of the carriage 29 and determining print timing is also connected to the gate array circuit 73.

The ROM 74 stores the purging control data shown in the tables 90 and 91 of FIGS. 3A and 3B for use in the purging control by the CPU 70.

The table 90 is referred to by the CPU 70 in the cases of the initial purging operation at the time of ink cartridge exchange and the second purging operation after the initial purging operation. As understood from FIG. 3A, the number of times of purging (number of times of driving the pump 43) for the initial purging operation is set to 6. Further, the numbers of times of purging are set to 1, 2 and 3 for the second purging operation in the cases where the period of time or the number of days (T) elapsed from the initial purging operation to the present print operation command (print data) received from the host computer 71 is between 3 and 6, between 6 and 9 and more than 9, respectively.

The table 91 is referred to by the CPU 70 in the cases where the previous purging operation is not the initial purging operation and the normal purging operation which is instructed by the control panel or another purging switch. As understood from FIG. 3B, the numbers of times of purging are set to 1, 2 and 3 for the present purging operation in the cases where the period of time or the number of days (T) elapsed from the previous purging operation to the present print operation command (print data) received from the host computer 71 is between 5 and 10, between 10 and 15 and more than 15, respectively. Further, the number of times of purging for the normal purging operation is set to 1.

The number of purging is set to the largest (6) for the initial purging operation, because the ink in a new ink cartridge must be led to the corresponding ink jet head when the old ink cartridge is exchanged. Further, it is because that air enters into an ink supply passage between the ink cartridge and the ink jet head when the ink cartridge is exchanged, and it becomes bubbles. Thus, more ink must be evacuated from the ink jet head in the initial purging operation to eliminate the ink admixed with bubbles than in other purging operations.

Further, the interval between the two successive purging operations is set shorter in the table 90 (pervious purging operation is the initial purging operation) than in the table 90 (previous purging operation is not the initial purging operation). Although the largest number (6) of purging are performed in the initial purging operation, the bubble may still remain in the ink after the initial purging operation. This remaining bubbles will grow and cause no jetting of ink. Therefore, it is effective to perform the second purging operation at the earlier timing before the bubbles grow to cause no jetting of the ink.

Figure 4:
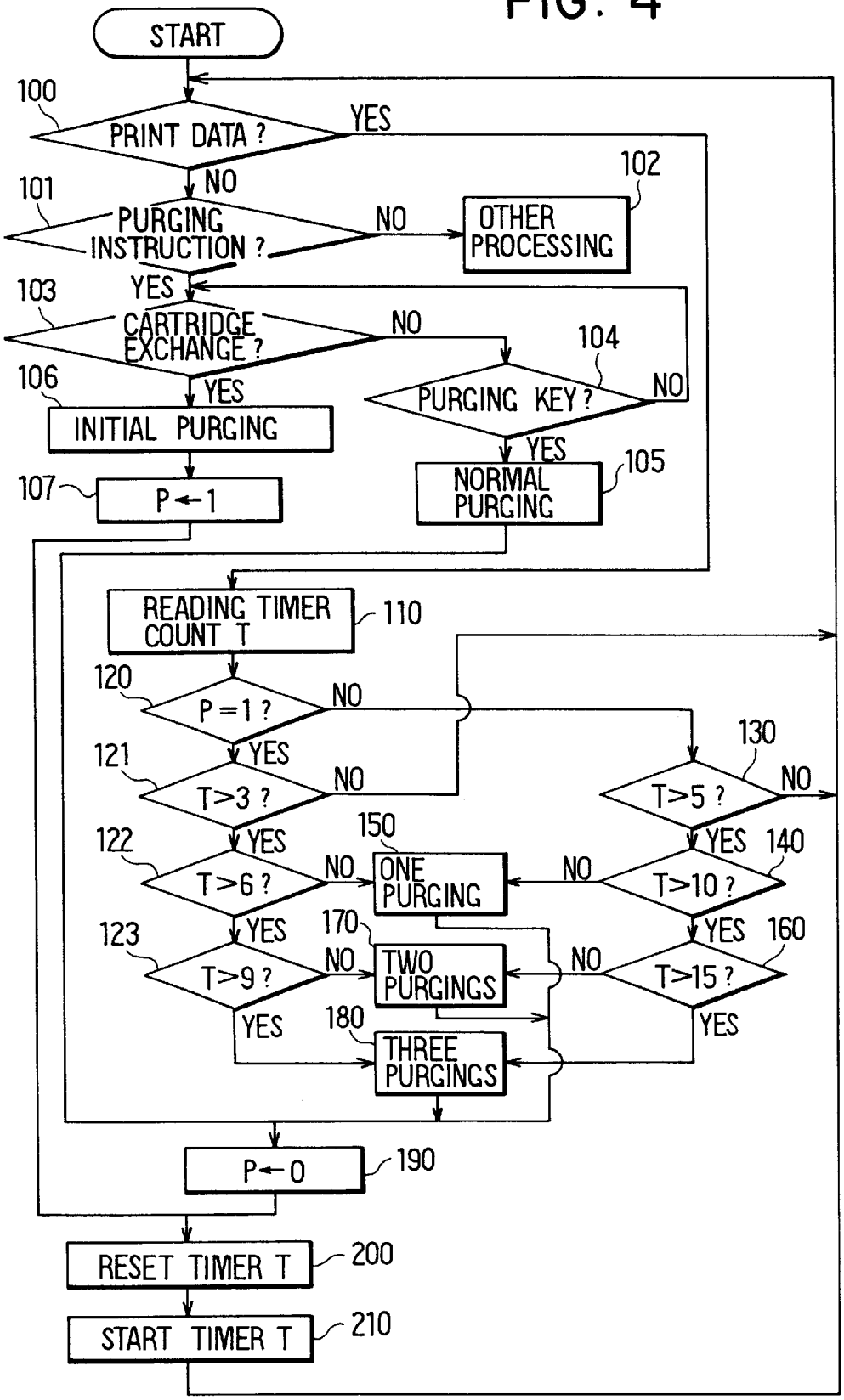
FIG. 4 is a flow chart showing a purging operation routine executed by a CPU of the control system shown in FIG. 2.

The CPU 70 performs the following purge control based on the purge control program (FIG. 4) stored in the ROM 74. This program may alternatively be stored in other memory devices such as a floppy diskette or CD-ROM in a computer-readable form. This purging control is executed for each of the ink jet heads 21 through 24.

(1) Without Print Data Input:

When CPU determines that a purging command is issued (step 101) after determining that no print data input is available (step 100), it then determines whether the ink cartridge has been exchanged i.e., whether the initial purging should be performed (step 103). This determination may be made based on the output of the cartridge sensor 88 or on the data in the host computer 71 indicative of a user's instruction for maintenance.

In the case of initial purging, the CPU 70 reads out the number of purging (6) from the table 90 stored in the ROM 74.

It then drives the printer head 20 to the home position where the evacuation cap 41 is located and advances the cap 41 to cover the corresponding nozzle-forming surface of the ink jet head which is to be subjected to purging. The pump 43 is driven six times to evacuate the ink inside the evacuation cap 41 through the corresponding nozzles (step 106). The CPU 70 then sets a flag P=1 indicating the initial purging operation (step 107) and restart the timer T (step 210) after resetting the timer T=0 (step 200). Thus, in this initial purging operation at the time of ink cartridge exchange, new ink will be introduced into the corresponding ink jet head and the bubbles in the new ink will be evacuated.

In the case of purging operations other than at the time of the ink cartridge exchange, for instance, in the case of the normal purging operation instructed by a user of the printer apparatus 10 through its host computer 71 or a purging key (step 104), the CPU reads out the number of purging (1) from the table 91 and performs the normal purging operation (step 105). If no purging operation is instructed, the CPU 70 executes other processing (step 102).

(2) With Print Data Input:

(i) After receiving the print data input from the host computer 71 (step 100), the CPU 70 reads out timer count value T indicative of the time period measured from the initial purging operation (step 110) and determines whether the previous purging operation is the initial one, P=1 (step 120). As long as the previous one is the initial purging operation, the CPU 70 determines whether the timer count (number of elapsed days) T is more than 3 (step 121). If not ($T \leqq 3$), printing operation is performed based on the print data input from the host computer 71 without second purging operation after the initial purging operation.

It is assumed that, within three days after the initial purging operation, the bubbles even if existing in the ink supply passage will not grow so much and the ink will not be dried so much either. Thus, no second purging operation is performed, thereby minimizing the wasting of ink which would be caused by the second purging operation.

If more than three but not more than six days ($3<T \leqq 6$) have passed since the initial purging operation (step 122), the CPU 70 reads out the number of times of purging (1) from the table 90 and drives the pump 43 once for one purging (step 150). If more than six but not more than nine days ($6<T \leqq 9$) have elapsed since the initial purging operation (step 123), the CPU 70 reads out the number of times of purging (2) from the table 90 and performs two purging (step 170). If more than nine days (T>9) have elapsed since the initial purging operation (step 123), the CPU 70 reads out the number of times of purging (3) from the table 90 and performs three purging (step 180).

After each of the above purging operations, the CPU 70 resets the flag to P=0 to indicate that the previous purging operation is not the initial one (step 190), resets the timer (T=0) and then starts to measure the time again. Then the CPU 70 starts the print operation.

Thus, as the number of elapsed days after the initial purging operation becomes larger, the number of times of purging is increased in each purging operation. This is because that the bubbles in the ink supply passage will grow bigger, more bubbles will be produced and the ink will be dried more as the time passes. Therefore, more ink is evacuated in proportion to the elapsed time.

(ii) In the case that the previous purging operation is not the initial one (P=0), the CPU 70 determines whether more than five days have passed (T>5) from the previous purging operation (step 130). If not, the CPU 70 performs the print operation without purging. As long as the previous purging operation is not the initial one, i.e., the second purging operation has been performed at one of the steps 105, 150, 170 and 180, it is expected that most of the bubbles in the ink has been evacuated or the bubbles have not yet grown so much. Therefore, the number of days after which the next purging operation is performed is set to 5 which is larger than 3 set for the second purging operation after the initial one, thus minimizing wasting of ink.

If more than five but not more than ten days ($5<T \leqq 10$) have passed since the previous purging operation (step 140), the CPU 70 reads out the number of times of purging (1) from the table 91 and drives the pump 43 once for one purging (step 150). If more than ten but not more than fifteen days ($10<T \leqq 15$) have elapsed since the previous purging operation (step 160), the CPU 70 reads out the number of times of purging (2) from the table 91 and performs two purging (step 170). If more than fifteen days (T>15) have elapsed since the previous purging operation (step 160), the CPU 70 reads out the number of times of purging (3) from the table 91 and performs three purging (step 180).

After each of the above purging operations, the CPU 70 maintains the flag at P=0 (step 190), resets the timer (T=0) and then starts to measure the time again. Then the CPU 70 starts the print operation.

Thus, as the number of elapsed days after the previous purging operation becomes larger, the number of times of purging is increased in each purging operation. This is because that the bubbles in the ink supply passage will grow bigger, more bubbles will be produced and the ink will be dried more as the time passes from the previous purging operation. Therefore, more ink is evacuated in proportion to the elapsed time.

The above embodiment may be so modified that a host computer including a CPU controls the above entire purging operation without using a separate CPU or that the host computer measures the elapsed time until the printing operation command by detecting the purging operation in the printer part. The program for this modification may be provided by a magnetic memory, for instance, which is computer-readable.

The above embodiment may be so modified further that a printer head uses a Kaiser-type device or a thermal jet-type device in place of the shear mode-type using a piezoelectric ceramics.

The above embodiment may be so modified still further that each of the ink jet heads of the printer head is driven to purge or exhaust bubbles admixed with the ink at the time of exchange of cartridges or before the normal printing operation without using the purging device.

According to the printer apparatus described above, more ink is absorbed to evacuate bubbles in the ink as the elapsed time (number of days) from the previous purging to the presently inputted print data becomes longer, i.e., as the period of non-use becomes longer. As a result, the ink jetting ability can be restored to upgrade the print quality irrespective of the length of non-use of the printer apparatus 10.

Further, the timing or time interval of enabling automatic purging operation from the previous one is varied in accordance with the determination whether the previous purging is the initial one as well as the time period of non-use of the printer apparatus. As a result, the print quality can be upgraded further.

The present invention should not be limited to the disclosed embodiment and modifications but may be altered or changed further without departing from the spirit of the invention.

What is claimed is:

1. An ink jet-type printer apparatus comprising:

a printer head including an ink cartridge for storing ink therein and nozzles for ejecting the ink stored in the ink cartridge;

a purging device that performs a purging operation of purging the ink through the nozzles;

a determination part that determines whether the purging operation is initial after an exchange of the ink cartridge or non-initial; and a control part that varies a period of the purging operation so that the amount of the ink purged when the purging operation is initial after the exchange of the ink cartridge is greater than the amount of the ink purged when the purging operation is non-initial after the exchange of the ink cartridge.

2. The printer apparatus of claim 1, further comprising:

a timer part that measures a non-use time period of the printer head;

wherein the period of the purging operation is varied in accordance with both the non-use time period and the determination result of the determination part.

3. The printer apparatus of claim 1, wherein:

the purging device includes a vacuuming member that vacuums the nozzles for the purging operation; and the control part increases a number of times of operation of the vacuuming member so that the amount of the ink purged when the purging operation is initial after the exchange of the ink cartridge is greater than the amount of the ink purged when the purging operation is non-initial after the exchange of the ink cartridge.

4. The printer apparatus of claim 1, wherein the determination part determines whether the purging operation is initial or non-initial based on an output of a sensor.

5. The printer apparatus of claim 4, wherein the sensor is an ink cartridge exchange detecting sensor.

6. A control method for an ink jet-type printer apparatus having a printer head including an ink cartridge for storing ink therein and nozzles for ejecting the ink stored in the ink cartridge, the control method comprising the steps of:

determining whether a purging operation is initial after an exchange of the ink cartridge or non-initial; and controlling the purging operation so that the amount of the ink purged when the purging operation is initial is greater than the amount of the ink purged when the purging operation is non-initial.

7. The control method of claim 6, wherein:

the purging operation includes a vacuuming operation to vacuum the nozzles; and the controlling step increases a time of vacuuming the nozzles when the purging operation is initial to be longer than when the purging operation is non-initial.

8. The control method of claim 7, wherein:

the controlling step increases a number of times of vacuuming the nozzles to increase the amount of the ink purged.

9. The control method of claim 6, wherein it is determined whether the purging operation is initial or non-initial based on an output of a sensor.

10. The control method of claim 9, wherein the sensor is an ink cartridge exchange detecting sensor.

11. A control method for an ink jet-type printer apparatus having a printer head including an ink cartridge for storing ink therein and nozzles for ejecting the ink stored in the ink cartridge, the control method comprising:

determining whether a previous purging operation is initial after an exchange of the ink cartridge or non-initial; and performing a purging operation after a predetermined time has elapsed from the previous purging operation, wherein the predetermined time is varied in accordance with whether the previous purging operation is initial or non-initial.

12. The control method of claim 11, wherein:

the purging operation includes a vacuuming operation to vacuum the nozzles; and the amount of the ink purged is varied by a period of vacuuming the nozzles.

13. The control method of claim 12, wherein:

the period of vacuuming the nozzles is determined by a number of times of vacuuming the nozzles.

14. The control method of claim 11, wherein it is determined whether the purging operation is initial or non-initial based on an output of a sensor.

15. The control method of claim 14, wherein the sensor is an ink cartridge exchangie detecting sensor.

16. A program for an ink jet-type printer apparatus having a printer head including an ink cartridge for storing ink therein and nozzles for ejecting the ink stored in the ink cartridge, the program comprising:

determining whether a purging operation is initial after an exchange of the ink cartridge or non-initial; and controlling the purging operation so that the amount of the ink purged when the purging operation is initial is greater than the amount of the ink purged when the purging operation is non-initial.

17. The program of claim 16, wherein:

the purging operation includes a vacuuming operation to vacuum the nozzles; and a time of vacuuming the nozzles when the purging operation is initial being longer than when the purging operation is non-initial.

18. The program of claim 16, wherein:

the amount of the ink purged is increased by increasing a number of times of vacuuming the nozzles.

19. The program of claim 16, wherein it is determined whether the purging operation is initial or non-initial based on an output of a sensor.

20. The program of claim 19, wherein the sensor is an ink cartridge exchange detecting sensor.

21. A control method for an ink jet-type printer apparatus having a printer head including an ink cartridge for storing ink therein and nozzles for ejecting the ink stored in the ink cartridge, the control method comprising:

determining a time period elapsed from a previous purging operation; and varying a period of a purging operation in accordance with the determined time period.

22. The control method of claim 21, further comprising the step of:

determining whether the purging operation is initial after an exchange of the ink cartridge or non-initial;

wherein the period of the purging operation when the purging operation is initial is greater than the period of the purging operation when the purging operation is noninitial.

23. The control method of claim 21, wherein:

the period of the purging operation is increased as the determined time period increases.

24. The control method of claim 21, wherein:

the purging operation includes a vacuuming operation to vacuum the nozzles; and the period of the purging operation is varied by a period of vacuuming the nozzles.

25. The control method of claim 24, wherein:

the period of vacuuming the nozzles is determined by a number of times of vacuuming the nozzles.

26. An ink jet-type printer comprising:

a printer head including an ink cartridge for storing ink therein and nozzles for ejecting the ink stored in the ink cartridge;

a purging device for performing a purging operation of the printer head when driven; and a controller for determining whether a previous purging operation of the purging device is initial after an exchange of the ink cartridge or non-initial, and driving the purging device to perform the purging operation after a predetermined time has elapsed from the previous purging operation, wherein the predetermined time is varied in accordance with whether the previous purging operation is initial or non-initial.

27. The ink jet-type printer of claim 26, wherein:

the purging operation includes a vacuuming operation to vacuum the nozzles; and an amount of the ink purged is varied by a period of vacuuming the nozzles.

28. The ink jet-type printer of claim 27, wherein:

the period of vacuuming the nozzles is determined by a number of times of vacuuming the nozzles.

29. The printer apparatus of claim 26, wherein the controller determines whether the purging operation is initial or non-initial based on an output of a sensor.

30. The printer apparatus of claim 29, wherein the sensor is an ink cartridge exchange detecting sensor.

* * * * *